US005467633A

United States Patent [19]

Kato

[11] Patent Number: 5,467,633

[45] Date of Patent: Nov. 21, 1995

[54] MECHANICAL PRESSING MACHINE

[75] Inventor: Heizaburo Kato, Shizuoka, Japan

[73] Assignee: Sankyo Seisakusho Co., Tokyo, Japan

[21] Appl. No.: 294,066

[22] Filed: Aug. 22, 1994

[30] Foreign Application Priority Data

Aug. 25, 1993 [JP] Japan ..... 5-210666

[51] Int. Cl.[6] ..... B21J 9/18

[52] U.S. Cl. ..... 72/452; 72/450; 100/292; 83/628

[58] Field of Search ..... 72/450, 451, 452; 100/282, 292; 83/627, 628, 630

[56] References Cited

U.S. PATENT DOCUMENTS

| | | | |
|---|---|---|---|
| 2,507,556 | 5/1950 | Bobst | 83/630 |
| 3,585,837 | 6/1971 | Bihler | 72/452 |
| 3,800,647 | 4/1974 | Morse et al. | 83/628 |
| 4,355,530 | 10/1982 | Chen | 72/452 |
| 4,638,731 | 1/1987 | Kato . | |
| 4,763,551 | 8/1988 | Halff et al. | 83/628 |
| 4,903,560 | 2/1990 | Halff et al. | 83/628 |

FOREIGN PATENT DOCUMENTS

| | | |
|---|---|---|
| 144546 | 10/1903 | Germany . |
| 942554 | 5/1956 | Germany . |
| 44-23853 | 10/1969 | Japan . |
| 8800027 | 8/1988 | WIPO . |

*Primary Examiner*—David Jones
*Attorney, Agent, or Firm*—Harness, Dickey & Pierce

[57] ABSTRACT

There is disclosed a mechanical pressing machine of the general-purpose type which has advantages of a crank press, a knuckle press and a cam press. The pressing machine includes a slider which is mounted on a frame for vertical sliding movement, and has an upper press die mounted on a lower surface thereof, a pair of sliding blocks mounted respectively on right and left side portions of the frame for horizontal sliding movement, a pair of right and left connecting rods which are rotatably connected at their one ends to the sliding blocks, respectively, and are rotatably connected at their other ends to the slider, an input shaft which is rotatably mounted on the frame, and is connected at its one end to a flywheel, and a rib cam mounted on the other end portion of the input shaft, the rib cam having a peripheral portion held between cam followers and a roller follower, mounted on each of the pair of sliding blocks, so as to reciprocally move the pair of sliding blocks right and left in a symmetrical manner.

4 Claims, 6 Drawing Sheets

MECHANICAL PRESSING MACHINE

BACKGROUND OF THE INVENTION

This invention relates to a mechanical pressing machine of the type in which a slider is reciprocally moved linearly through a rotation cam.

Generally, depending on the type of drive mechanism for a slider, mechanical pressing machines are classified into a crank press, a knuckle press (toggle press) and a cam press. In a crank press, a rotational energy stored in a flywheel is converted into a linear reciprocal motion of a slider through a crankshaft and a connecting rod. Although the crank press is simple in construction, and has been most extensively used, it has problems with respect to rigidity and the generation of heat. In a knuckle press, a rotational energy of a flywheel is converted into a linear reciprocal motion of a slider through a crankshaft, a connecting rod and a knuckle link. In the knuckle press, a change in stroke is small in the vicinity of a lower dead center, and this press well withstands an impact load, but has a problem that the construction is complicated. In a cam press, a rotational energy of a flywheel is converted into a linear reciprocal motion of a slider through a cam and a connecting rod. Although it is rather difficult to manufacture a cam, the cam press has a feature that a curve of motion of the slider can be freely set by suitably determining the configuration of the cam.

Mechanical presses are also classified in terms of the number of portions of connection between a slider drive mechanism and a slider. More specifically, those presses having one connection portion are called a single-point press, those presses having two connection portions are called a two-point press, and those presses having four connection portions, in which two connection points are provided respectively adjacent to the other two connection points in juxtaposed relation thereto, are called a four-point press. The single-point press is suited for pressing a relatively small area which does not impart an unbalanced load to the slider, and the two-point press and the four-point press are suited for pressing a relatively large area which imparts an unbalanced load to the slider. The center of gravity of a die mounted on the press is not always disposed at the center of the pressing machine, and also a load during the pressing operation is not always disposed at the center of the pressing machine. Therefore, when the pressing operation is carried out through the slider on which the die subjected to such an unbalanced load is mounted, the slider is tilted in the single-point press, so that a precise pressing operation can not be carried out.

As described above, there are several kinds of conventional presses which have their respective advantages and disadvantages, and they have been selectively used in accordance with the type of working. However, the pressing machines are costly, and if a different pressing machine is introduced each time a different type of working is to be carried out, high facility costs and a large installation space are needed, and additional facilities suited respectively for several kinds of pressing machines are necessary. This results in a problem that the cost of the product is increased. Therefore, it has been desired to provide a general-purpose pressing machine which has the advantages of different kinds of conventional pressing machines.

SUMMARY OF THE INVENTION

With the above problems in view, it is an object of this invention to provide a general-purpose mechanical pressing machine which has the advantages of the conventional pressing machines.

According to the present invention, there is provided a mechanical pressing machine comprising:

- a slider supported on a frame for vertical sliding movement, the slider having an upper press die mounted on its lower surface;
- a pair of sliding blocks mounted respectively on right and left side portions of the frame for horizontal sliding movement;
- a cam follower and a roller follower rotatably mounted on each of the pair of sliding blocks;
- a pair of right and left connecting rods rotatably connected at their one ends to the pair of sliding blocks, respectively, the other ends of the pair of connecting rods being rotatably connected to the slider;
- an input shaft rotatably mounted on the frame, the input shaft being connected at its one end to rotation transmission means; and
- a rib cam mounted on the other end portion of the input shaft for rotation therewith, the rib cam having a peripheral portion held between the cam follower and the roller follower on each of the pair of sliding blocks so as to reciprocally move the pair of sliding blocks right and left in a symmetrical manner.

Therefore, in the present invention, the rib cam, the sliding blocks, the connecting rods and the slider jointly provide such a construction as achieved by the combination of a knuckle press and a cam press. Thus, there is provided the excellent mechanical pressing machine which is simple in construction, is less affected thermally, well withstands an impact and an unbalanced load, and enables a curve of motion to be freely selected.

BRIEF DESCRIPTION OF THE INVENTION

DESCRIPTION OF THE PREFERRED EMBODIMENTS

Figure 1:
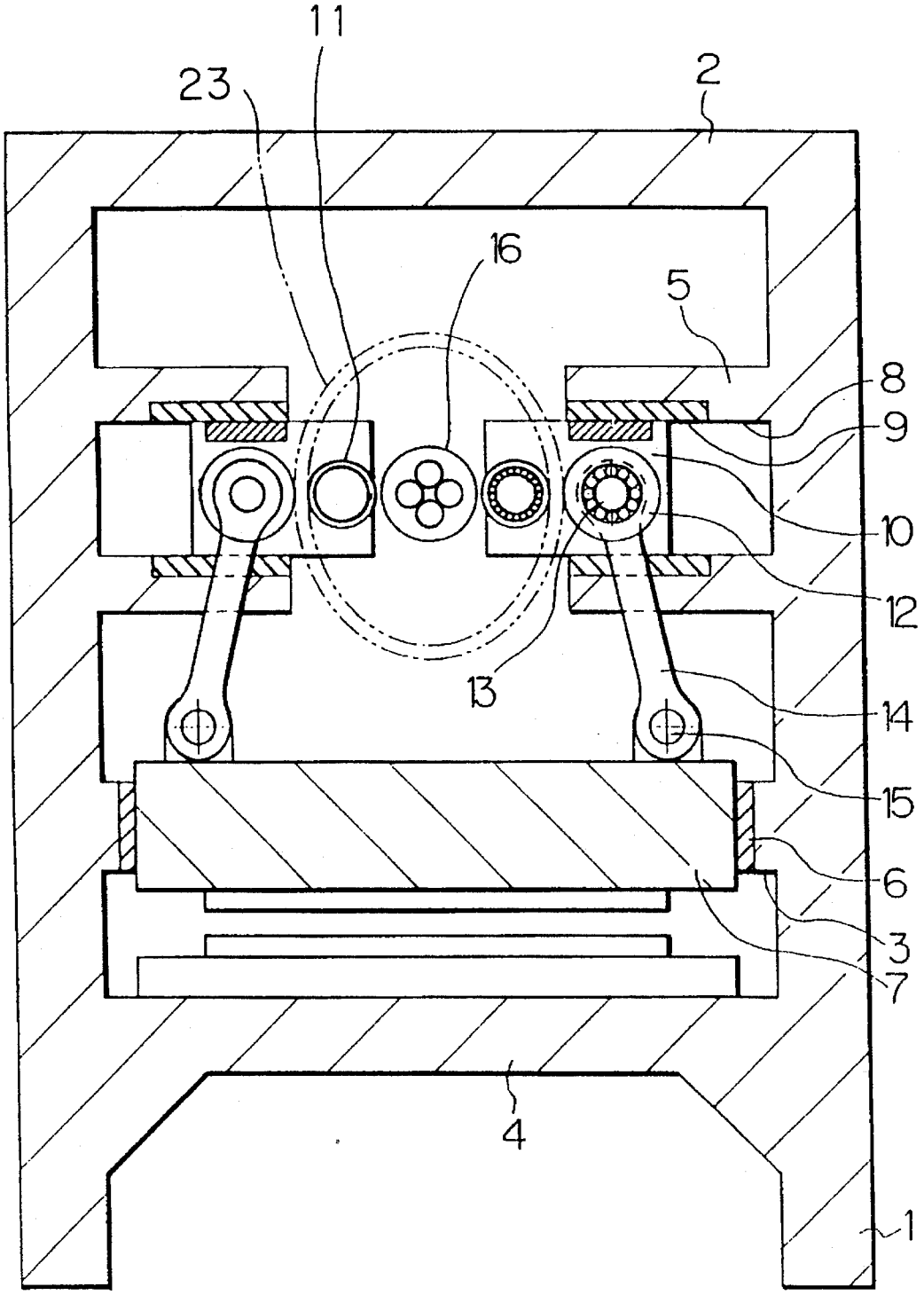
FIG. 1 is a schematic cross-sectional view of one preferred embodiment of a mechanical pressing machine of the present invention as viewed from a front side thereof.
Figure 2:
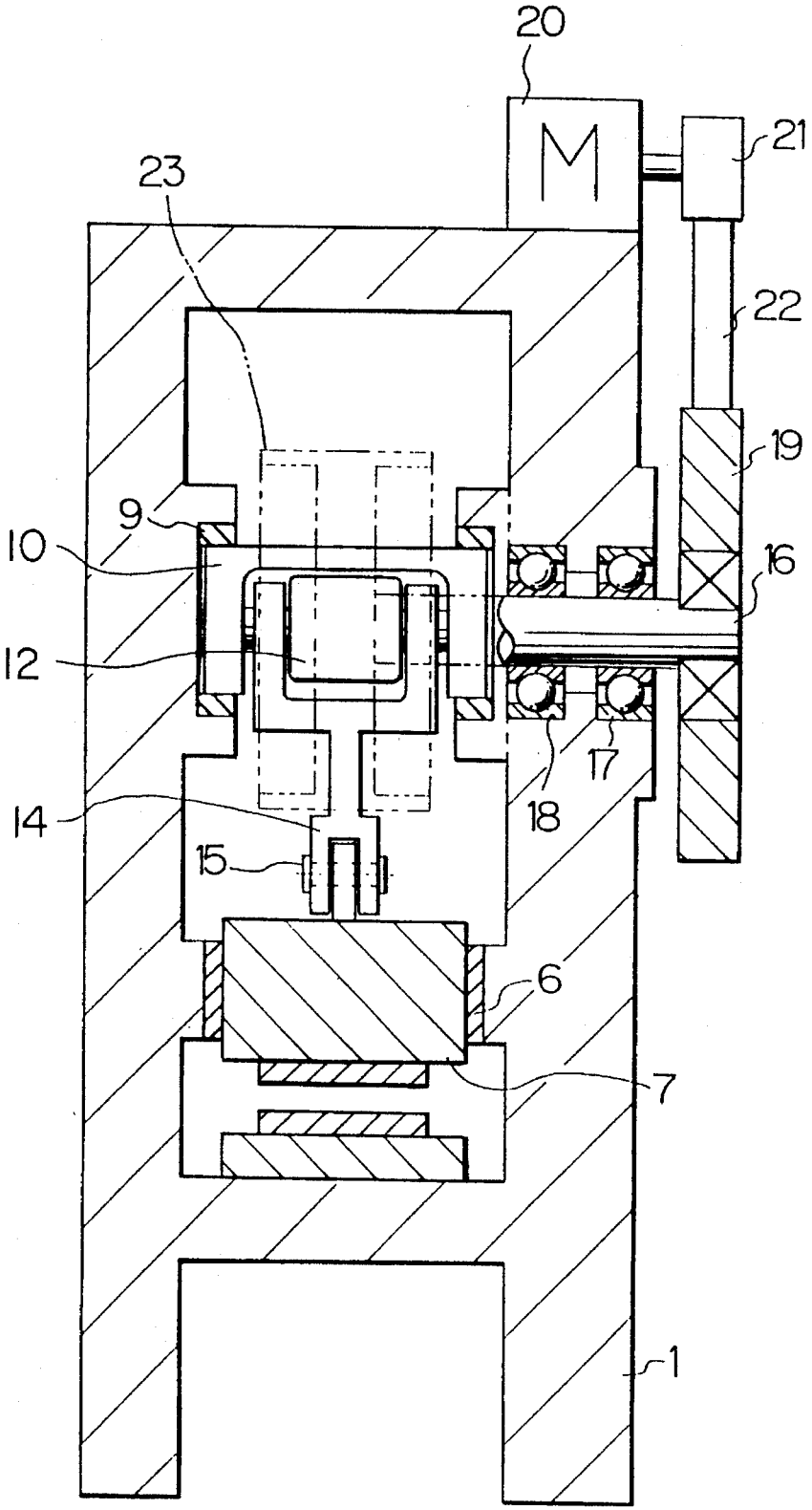
FIG. 2 is a schematic cross-sectional view of the pressing machine as viewed from a side thereof.
Figure 3:
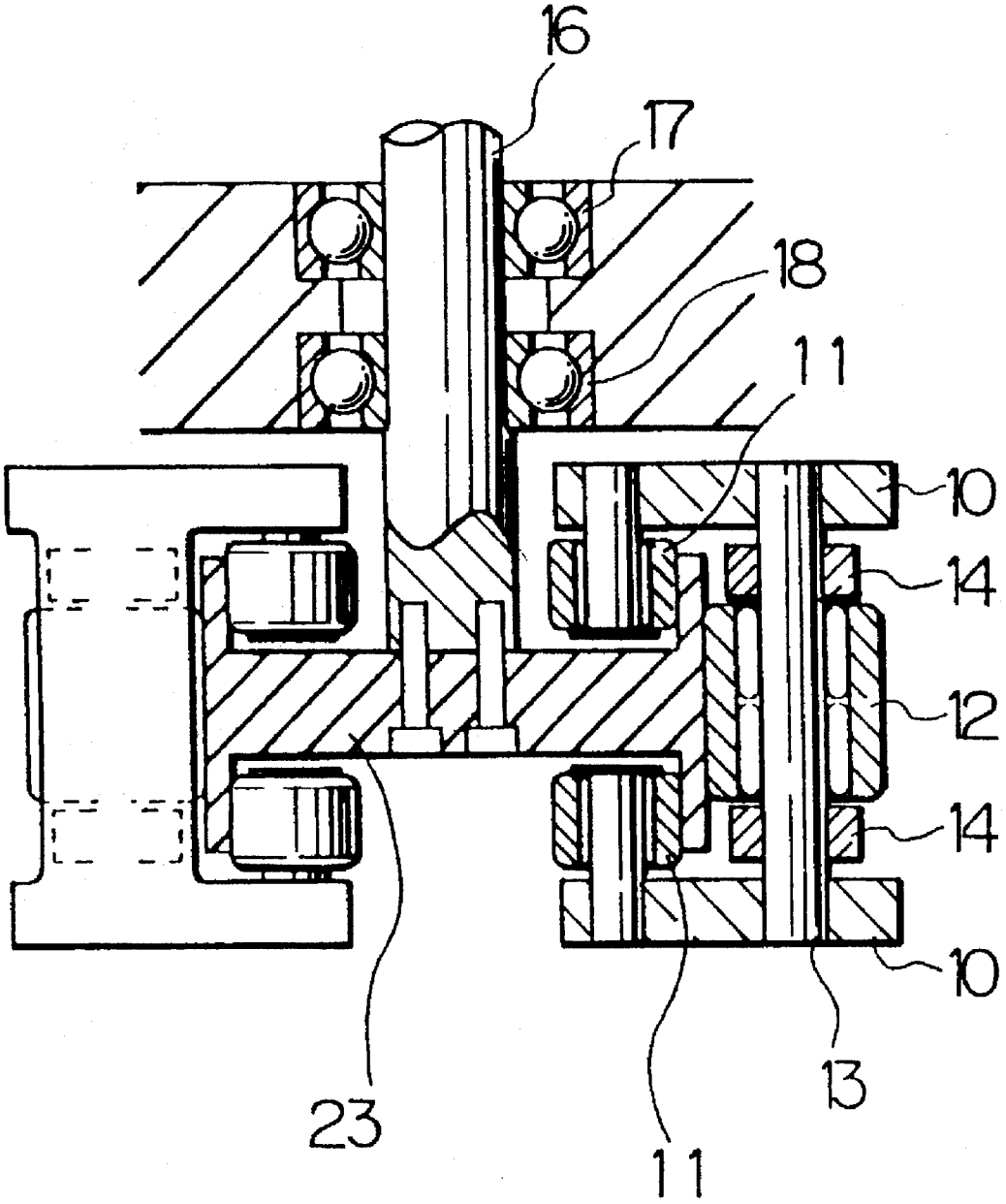
FIG. 3 is a schematic cross-sectional view of a cam mechanism portion as viewed from a top of the pressing machine.

FIG. 1 is a schematic cross-sectional view of one preferred embodiment of a mechanical pressing machine of the present invention as viewed from a front side thereof, FIG. 2 is a schematic cross-sectional view of the pressing machine as viewed from a side thereof, and FIG. 3 is a schematic cross-sectional view of a cam mechanism portion as viewed from a top of the pressing machine. A frame 1 includes an upper support portion 2, an intermediate support portion 3, a lower support portion 4, and a pair of intermediate projection portions 5 which are provided between the upper support portion 2 and the intermediate support portion 3, and are projected inwardly toward each other respectively from right and left side walls of the frame 1. A slider 7 of a rectangular shape is supported through a bearing 6 on the intermediate support portion 3 for sliding movement in a vertical direction. An upper press die is mounted on a lower surface of the slider 7. A guide groove 8 is formed in each of the right and left intermediate projection portions 5, and extends horizontally. A sliding block 10 is slidably received in each of the guide grooves 8 through a bearing 9. Two cam followers 11 are rotatably mounted on an inner portion of each of the pair of right and left sliding blocks 10, and a roller follower 12 is rotatably mounted on an outer portion of each block 10. A connecting rod 14 is rotatably or pivotally mounted at its one bifurcated end on a support shaft 13 for each roller follower 12 in such a manner that the roller follower 12 is received in the bifurcated end of the connecting rod 14. The other bifurcated end of each connecting rod 14 is rotatably connected to an upper surface of the slider 7 through a connecting pin 15.

An input shaft 16 is rotatably supported on a rear wall of the frame 1 through bearings 17 and 18, the input shaft 16 extending through the rear wall from a rear side of the frame 1 toward a front side thereof. A flywheel 19 is fixedly mounted on one end of the input shaft 16, and is driven by a motor 20 for rotation through a pulley 21, fixedly mounted on a rotation shaft of the motor 20, and a belt 22 extended around the pulley 21 and the flywheel 19. A rib cam 23 is fixedly mounted on the other end portion of the input shaft 16, and has a rim formed at its outer peripheral edge and projected forwardly and rearwardly. The rim of the rib cam 23 is symmetrical with respect to the center or axis of rotation of the rib cam 23. The two cam followers 11 supported on each sliding block 10 are held in contact with an inner peripheral surface of the rim of the rib cam 23 whereas the roller follower 12 supported on each sliding block 10 is held in contact with an outer peripheral surface of the rim of the rib cam 23. The two cam followers 11 and the roller follower 12 supported on each sliding block 10 are rotated in accordance with the rotation of the rib cam 23 to reciprocally move the pair of sliding blocks 10 right and left in opposite directions, that is, toward and away from each other. In order to move the pair of sliding blocks 10 right and left in a symmetrical manner, the rib cam 23 is designed such that $S=2n$ ($n=1, 2, 3, 4 \ldots$) is established where S represents the number of crests of the rib cam 23. For example, if $n=1$ is selected, $S=2$ is obtained, and therefore there is provided a 180° symmetrical cam in which the number of crests as well as the number of valleys is two. If $n=2$ is selected, there is provided a quartered cam in which the number of crests as well as the number of valleys is four, in which case the center of gravity of the cam always coincides with the axis of rotation of the cam, so that the cam has a good rotational balance. The positions of the right and left connecting pins 15 on the upper surface of the slider 7, the positions of the right and left support pins 13 on the sliding blocks 10, and the position of rotation of the rib cam 23 are so determined that the speed is the lowest at a lower dead center of the stroke of the slider 7, thus providing a kind of toggle mechanism.

The operation of the above mechanical pressing machine will now be described. When the motor 20 is rotated to transmit its rotational force to the flywheel 19 via the pulley 21 and the belt 22, the rib cam 23 is rotated or angularly moved from the illustrated position (where the valleys of the rib cam 23 are disposed at the cam followers 11 and the roller followers 12), so that the right and left sliding blocks 10 are moved away from each other from the illustrated positions into right-left symmetrical positions, respectively. In accordance with this movement, each connecting rod 14 is moved toward a vertically-disposed position to move the slider 7 downward from the illustrated upper dead center. When the rib cam 23 rotates through 90 degrees, so that the crests of the rib cam 23 reach the cam followers 11 and the roller followers 12, the pair of sliding blocks 10 are spaced apart farthest from each other, and the slider 7 is disposed at the lower dead center, thereby working a workpiece. At this time, a pressing load in the vicinity of the lower dead center is transmitted to the two connecting rods 14, and acts to urge the slider 7 upward, and most of component forces of the load acting on the slider 7 are directly transmitted to the frame 1 through the bearings 9, and the remaining component forces act as a load urging the rib cam 23. Therefore, the load acting on the rib cam 23 is reduced, and this advantageously enhances the safety of the cam device. And besides, the slider 7 is connected to the two connecting rods 14, thus constituting a two-point press, and therefore even if the die is subjected to an unbalanced load, the parallelism of the sliding blocks 10 will not be affected, and hence the slider 7 can be driven without being tilted, and therefore the pressing operation can be carried out with a high precision.

Figure 4:
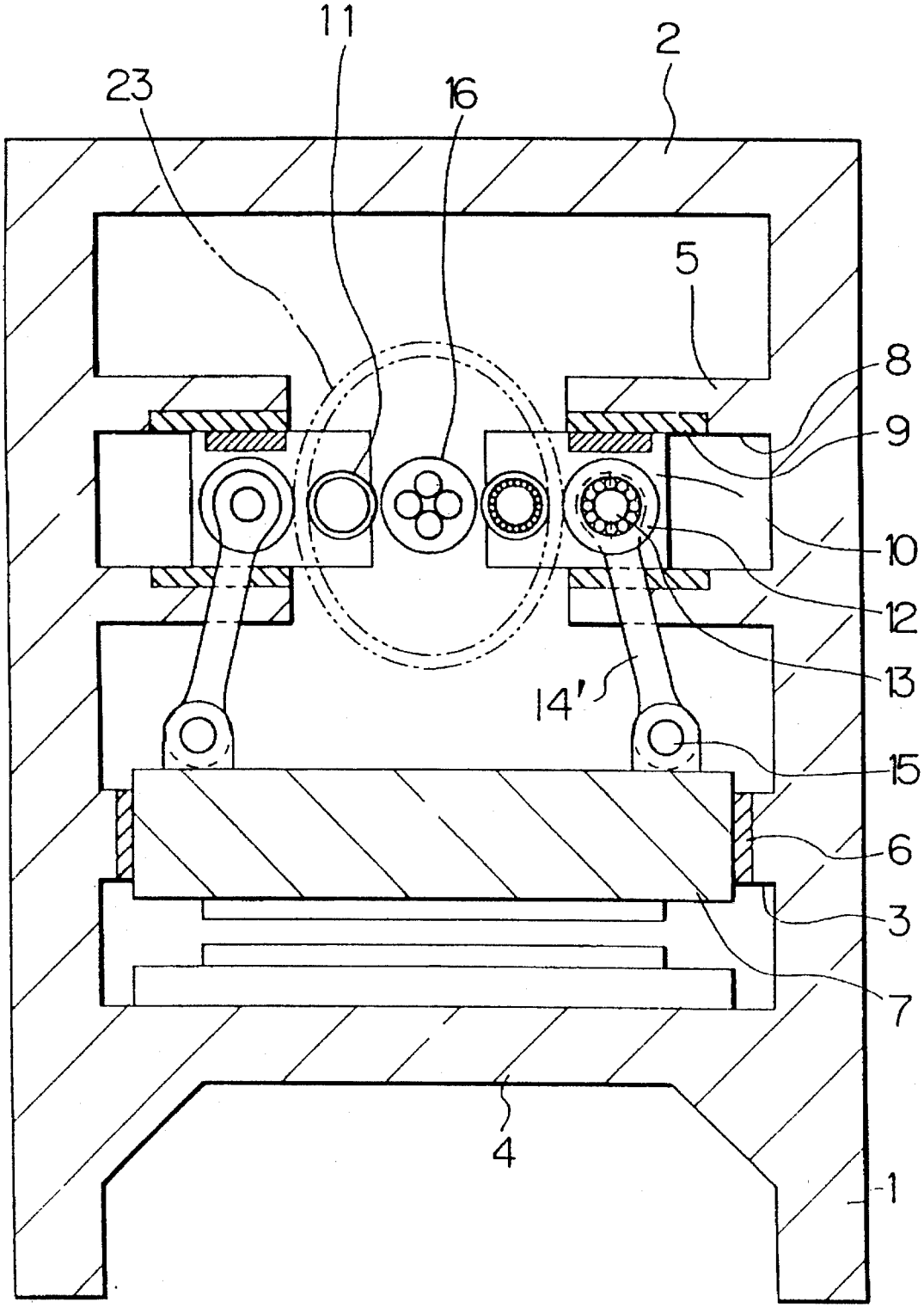
FIG. 4 is a schematic cross-sectional view of another preferred embodiment of a mechanical pressing machine of the present invention as viewed from a front side thereof.
Figure 5:
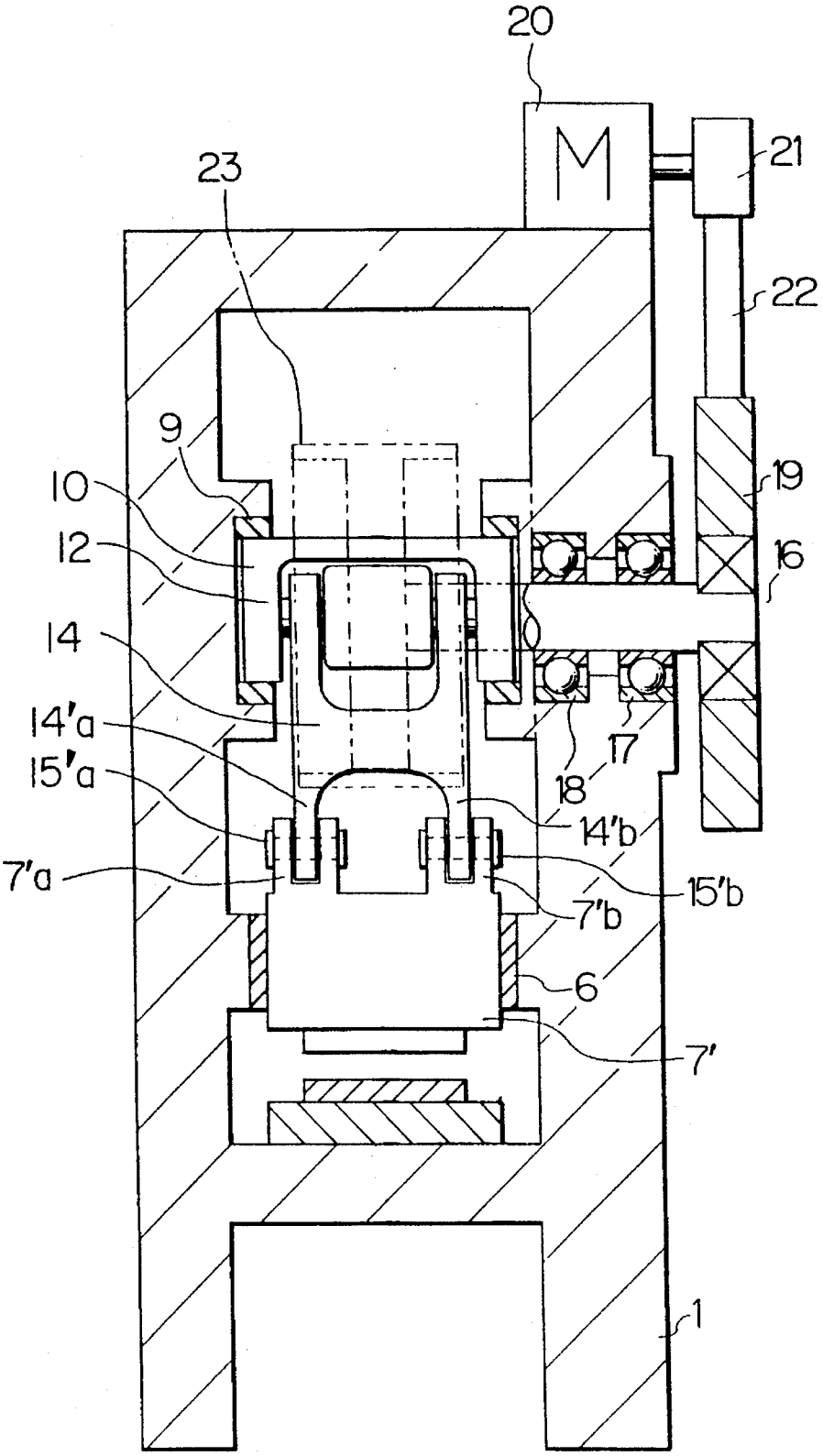
FIG. 5 is a schematic cross-sectional view of the pressing machine of FIG. 4 as viewed from a side thereof.
Figure 6:
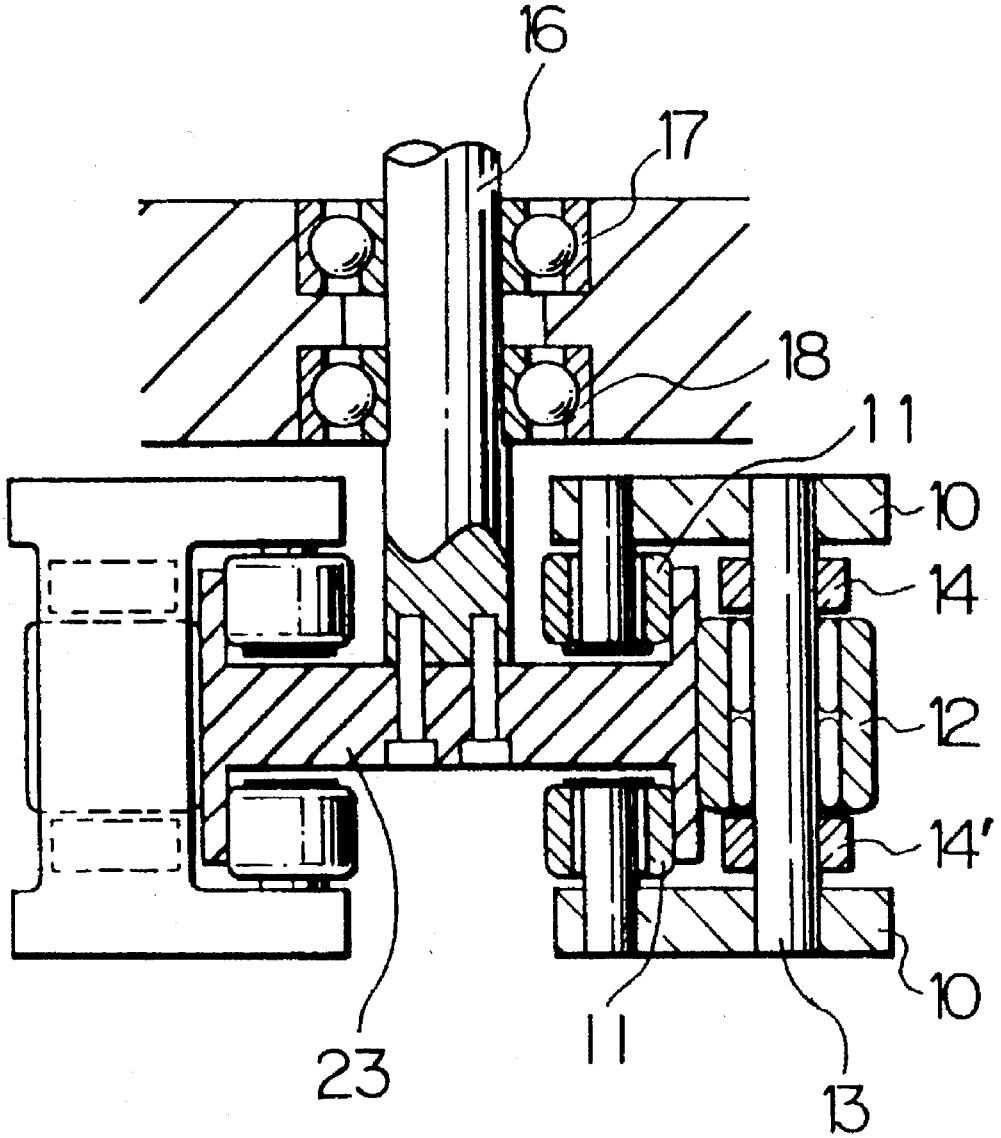
FIG. 6 is a schematic cross-sectional view of a cam mechanism portion as viewed from a top of the pressing machine of FIG. 4.

FIGS. 4 to 6 shows another preferred embodiment of the present invention. This embodiment differs from the first-mentioned embodiment only in that the points of connection between a slider 7' and connecting rods 14' are four. More specifically, a pair of bifurcated connecting portions **7'*a* and 7'*b* are formed on each of right and left end portions of an upper surface of the slider 7'. Two connecting portions 14'*a* and 14'*b* are formed at a lower end of each of the two connecting rods 14', and are rotatably connected by respective connecting pins 15'*a* and 15'*b* to the connecting portions 7'*a* and 7'*b*, respectively. The other construction is the same as that of the first embodiment, and therefore explanation thereof will be omitted. In this embodiment, because of the four-point connection arrangement, the slider 7'** is prevented from being tilted not only right and left but also forwardly and rearwardly.

As described above, in the present invention, the rib cam, the sliding block and the connecting rods jointly constitute a kind of toggle mechanism, and the two- or four-point press is provided, and therefore there can be achieved the mechanical pressing machine which is simple in construction, is short in stress path, well withstands an impact load of the press and an unbalanced load, and is less affected thermally. Furthermore, because of the toggle effect, the speed is reduced in the vicinity of the lower dead center, and therefore there can be provided the mechanical pressing machine which is highly precise at the lower dead center, and reduces noises. Moreover, there can be achieved advantageous effects that a curve of motion can be freely selected since the cam is used as a driver, that a good rotational balance can be obtained since the number of crests of the cam is set to an integral multiple of 2, and that the efficiency of the operation is high since the cam mechanism of the rolling pair is used.

What is claimed is:

1. A mechanical pressing machine comprising:

a slider supported on a frame for vertical sliding movement, said slider having an upper press die mounted on its lower surface;

a pair of sliding blocks mounted respectively on right and left side portions of said frame for horizontal sliding movement;

a cam follower and a roller follower rotatably mounted on each of said pair of sliding blocks;

a pair of right and left connecting rods rotatably connected at their one ends to said pair of sliding blocks, respectively, the other ends of said pair of connecting rods being rotatably connected to said slider;

an input shaft rotatably mounted on said frame, said input shaft being connected at its one end to rotation transmission means; and a rib cam mounted on the other end portion of said input shaft for rotation therewith, said rib cam having a peripheral portion held between said cam follower and said roller follower on each of said pair of sliding blocks so as to reciprocally move said pair of sliding blocks right and left in a symmetrical manner.

2. A mechanical pressing machine according to claim 1, in which said other end of each of said pair of connecting rods is connected to said slider at two points.

3. A mechanical pressing machine according to claim 1, in which said rib cam has a rim formed at its outer peripheral edge which rim is held between said cam follower and said roller follower mounted on each of said pair of sliding blocks, said rim being symmetrical with respect to an axis of rotation of said rib cam, and said rim having crests the number of which is an integral multiple of 2.

4. A mechanical pressing machine according to claim 2, in which said rib cam has a rim formed at its outer peripheral edge which rim is held between said cam follower and said roller follower mounted on each of said pair of sliding blocks, said rim being symmetrical with respect to an axis of rotation of said rib cam, and said rim having crests the number of which is an integral multiple of 2.

* * * * *